US008844689B2

(12) United States Patent
Murdoch et al.

(10) Patent No.: US 8,844,689 B2
(45) Date of Patent: Sep. 30, 2014

(54) CARRY-ON WHEELED LUGGAGE FOR PHOTOGRAPHIC EQUIPMENT

(75) Inventors: Douglas Harland Murdoch, Santa Rosa, CA (US); Michael Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 0 days.

(21) Appl. No.: 13/406,504

(22) Filed: Feb. 27, 2012

(65) Prior Publication Data

US 2012/0217110 A1 Aug. 30, 2012

Related U.S. Application Data

(62) Division of application No. 11/908,400, filed as application No. PCT/US2006/009464 on Mar. 15, 2006, now Pat. No. 8,123,007.

(60) Provisional application No. 60/662,458, filed on Mar. 15, 2005.

(51) Int. Cl.

| | |
|---|---|
| ***A45C 5/14*** | (2006.01) |
| ***A45C 11/38*** | (2006.01) |
| ***A45C 13/08*** | (2006.01) |
| *A45C 13/20* | (2006.01) |
| *A45C 13/26* | (2006.01) |
| *A45C 13/02* | (2006.01) |

(52) U.S. Cl.

CPC . *A45C 11/38* (2013.01); *A45C 5/14* (2013.01); *A45C 13/20* (2013.01); *A45C 13/262* (2013.01); *A45C 2013/026* (2013.01); *Y10S 224/908* (2013.01)

USPC ..... 190/18 A; 190/101; 190/109; 190/111; 206/316.2; 224/908

(58) Field of Classification Search

CPC ..... A45C 11/38

USPC ..... 190/109, 111, 903, 18 A, 101; 206/316.2, 578; 224/908

See application file for complete search history.

(56) References Cited

U.S. PATENT DOCUMENTS

| | | | | |
|---|---|---|---|---|
| 257,003 | A | 4/1882 | Harris | |
| 4,066,195 | A | 1/1978 | Dickler | |
| 4,738,341 | A | 4/1988 | Asano | |
| 5,240,106 | A | 8/1993 | Plath | |
| 5,431,428 | A | 7/1995 | Marchwiak et al. | |
| 5,645,146 | A | 7/1997 | Bieber et al. | |
| 5,762,169 | A | 6/1998 | Deliman et al. | |
| 5,833,039 | A | 11/1998 | Kotkins et al. | |
| 6,098,768 | A | 8/2000 | Tsai | |
| 6,298,964 | B1 | 10/2001 | Sadow | |
| 6,318,552 | B1 * | 11/2001 | Godshaw | 206/320 |
| 6,536,568 | B1 | 3/2003 | Tong | |
| 6,575,493 | B1 * | 6/2003 | Lowenstein | 280/655.1 |
| 6,695,107 | B2 | 2/2004 | Godshaw et al. | |
| 7,900,758 | B2 * | 3/2011 | King et al. | 190/112 |
| 8,123,007 | B2 | 2/2012 | Murdoch et al. | |
| 2004/0237606 | A1 | 12/2004 | Iwamoto | |

* cited by examiner

*Primary Examiner* — Sue A Weaver

(74) *Attorney, Agent, or Firm* — R. Dabney Eastham

(57) ABSTRACT

The invention provides a carry-on wheeled luggage (1) for photographic equipment that has an interior compartment (80) deep enough to accommodate a large article of photographic equipment such as at least a 400 mm 2.8 f-stop aperture telephoto lens.

12 Claims, 12 Drawing Sheets

122
120
332
60
1
84
62
22
342
341
82
311
30
28
26
200
315
100
80
300
312
82A
311
315
22
140
70
130
72
340
60
82
84
62
124
120
126
30
110
A
350
82A
132

CARRY-ON WHEELED LUGGAGE FOR PHOTOGRAPHIC EQUIPMENT

CROSS-REFERENCE TO RELATED APPLICATIONS

This application is a divisional of U.S. non-provisional application Ser. No. 11/908,400, issued as U.S. Pat. No. 8,123,007 on Feb. 28, 2012, and which had a 371 filing date of Sep. 11, 2007 and was a 371 filing of international patent application number PCT/US2006/009464. International patent application number PCT/US2006/009464 was filed on Mar. 15, 2006 and claimed the benefit of priority from U.S. provisional patent application Ser. No. 60/662,458, filed on Mar. 15, 2005 for a "Carry-On Wheeled Luggage for Photographic Equipment," by Douglas Harland Murdoch and Michael Sturm, and assigned to Think Tank Photo, Inc., the disclosure of which is incorporated herein by reference.

STATEMENT REGARDING FEDERALLY SPONSORED RESEARCH OR DEVELOPMENT

Not applicable.

FIELD

The invention relates to carriers for objects such as photographic gear and the like. The invention relates to luggage and in particular wheeled luggage adapted for air travel.

BACKGROUND

A modern professional photographer in the field typically carries a digital or film camera system comprising at least one single lens reflex (SLR) camera body and several lenses for attachment to the camera body.

A professional photographer needs a piece of luggage or carrier for this photographic equipment that is as compact as possible. Such a piece of luggage preferably should be made to fit the limits for carry-on-board bags for air transportation because a photographer usually does not wish to have her expensive and delicate photographic equipment transported in checked luggage. In addition, a piece of luggage meeting these size limitations will be more convenient to carry in the field.

Carry-on luggage size limitations vary with the airline but most domestic (U.S.) airlines permit a carry-on piece of luggage that is 45 linear (total of the three dimensions) inches. A common sized bag for carry-on luggage that just meets but does not exceed this requirement measures twenty-two inches in height by fourteen inches in width by nine inches in depth. Some domestic and foreign airlines specify the maximum sizes permitted for specific dimensions (height, width or depth). Other airlines specify different maxima for the total linear inches of the carry-on luggage. Currently, carry-on luggage that does not exceed twenty-two inches in height by fourteen inches in width by nine inches in depth will satisfy most airlines' size limitations.

A carry-on piece of luggage preferably should be able to accommodate an extra-large telephoto lens. An extra-large telephoto lens often used by sports photojournalists and other professional photographers is a 400 mm 2.8 f-stop aperture telephoto lens (sometimes referred to as a "400" or "4"). Both Canon and Nikon make such a lens. By itself, with the lens hood for shielding from the sun reversed in the storage position on the front of the lens, the lens measures 8 inches in maximum diameter by 14.75 inches long. The part of the lens with the maximum diameter when configured this way is 7.2 inches long. This lens also weighs about 20 pounds. A carry-on piece of luggage preferably should allow for the carrying of very large (and heavy) lenses such as this telephoto lens, and preferably even larger lenses such as a 500 mm 4 f-stop or even a 600 mm 4 f-stop telephoto lens.

Preferably, the carry-on piece of luggage should be able to carry a 500 mm 4 f-stop or even a 600 mm 4 f-stop telephoto lens with lens hood mounted in the reversed position.

A collection of photographic equipment can be heavy, whether because it includes a large and weighty piece such as the 400 mm 2.8 f-stop aperture telephoto lens or simply a significant number of lighter lenses, camera bodies, spare batteries, and the like. The photographer who does not approach the fitness standards of special operations troops will tend to prefer a piece of luggage that is wheeled so that she can pull it behind her, the weight being supported by the wheels. This will be especially advantageous when walking significant distances, as in some airports.

Adding wheels to a carry-on piece of luggage for photographic equipment generally requires a frame and handle assembly to be incorporated in the piece of luggage that reduces the depth of the piece of luggage. Large articles of photographic equipment, such as the 400 mm 2.8 f-stop aperture telephoto lens, hitherto could not be accommodated in a carry-on piece of luggage while meeting the nine-inch depth of the most generally acceptable carry-on luggage size restrictions. No known carry-on wheeled luggage is capable of accommodating a bulky lens such as the 400 mm 2.8 f-stop aperture telephoto lens, at least because the frame and handle assembly shortens the depth of the internal compartment of the luggage.

Accordingly, a need exists for a wheeled piece of luggage designed to carry bulky photographic equipment while meeting carry-on luggage size restrictions.

In particular, a need exists for carry-on wheeled piece of luggage designed to carry a large telephoto lens, such as a 400 mm 2.8 f-stop aperture telephoto lens, in addition to other photographic equipment.

A 400 mm 2.8 f-stop aperture telephoto lens is a very expensive piece of photographic gear. A need also exists for means for securing luggage that may contain valuable gear from unauthorized removal such as theft. Preferably this means should be incorporated into the luggage.

SUMMARY

The invention satisfies these needs by providing a piece of wheeled carry-on luggage that can contain an extra-large long focal length large aperture lens and in particular at least a 400 mm 2.8 f-stop aperture telephoto lens.

In one embodiment of the carry-on wheeled luggage according to the invention, the piece of luggage comprises a receiver having walls defining an internal compartment and containing an extendable handle assembly that does not extend into a bottom portion of the internal compartment so that the bottom portion of the internal compartment can have a greater depth. The internal compartment can contain an extra-large long focal length large aperture lens and in particular at least a 400 mm 2.8 f-stop aperture telephoto lens.

In another embodiment, the invention provides a piece of luggage for articles such as photographic equipment comprising a receiver having dimensions consistent with carry-on luggage restrictions and defining an internal compartment capable of accommodating at least a 400 mm 2.8 f-stop aperture telephoto lens, and a frame assembly attached to the receiver comprising a telescoping handle assembly and wheels attached to the receiver whereby a user can grasp the handle assembly when in an extended configuration and pull or push the receiver of the piece of luggage across a surface in an inclined position while the receiver is supported by the wheels.

In a further embodiment, the invention provides a piece of luggage for articles such as photographic equipment and the like, comprising a receiver having a first wall, a second wall, two side walls, a top wall, and a bottom wall, the first wall and the second wall facing each other and being joined to the bottom wall, the side walls, and the top wall so as to define an internal compartment, the receiver having dimensions consistent with airline carry-on luggage rules and in particular the first wall, second wall, and two side walls having a height consistent with the vertical dimension allowed by airline carry-on luggage rules and the top wall, bottom wall, and side walls having a depth consistent with the minimum horizontal dimension allowed by airline carry-on luggage rules; a first opening defined in the receiver portion adjacent and parallel to the first wall for providing entry to the compartment from the exterior of the carrier; a zipper having complementary halves attached on either side of the first opening, the halves of the first zipper having at least one slider for reversibly separating the halves of the first zipper for permitting access to the first sub-compartment and reversibly attaching the halves of the first zipper for securing the first opening from entry from the exterior of the carrier; a second opening defined in the receiver portion adjacent to one of the second wall and the top wall providing entry to the internal compartment from the exterior of the carrier; two wheels attached to the receiver adjacent the bottom wall and extending away from the receiver whereby the wheels can support a substantial part of the weight of the piece of luggage when the receiver is substantially above the wheels and the wheels are in contact with a surface; an extendable handle assembly attached to the receiver and containable within the internal compartment when in a first contracted configuration and having a second extended configuration whereby a part of the handle assembly extends outwardly from the internal compartment through the second opening and generally vertically above the receiver whereby a user can grasp the handle assembly and pull or push the receiver of the piece of luggage across the surface in an inclined position; the handle assembly having a vertical length when in the first contracted configuration thereof that is less than the height of the receiver so that the handle assembly does not extend into a bottom portion of the internal compartment; and the internal compartment being sized to be capable of accommodating a long focal length wide aperture lens whereby the widest part of the long focal length wide aperture lens is contained in the bottom portion of the compartment.

In a still further embodiment the invention provides a piece of carry-on luggage for articles such as photographic equipment and the like, comprising: a receiver having a first wall, a second wall, two side walls, a top wall, and a bottom wall, the first wall and the second wall facing each other and being joined to the bottom wall, the side walls, and the top wall so as to define an internal compartment, the receiver having dimensions consistent with airline carry-on luggage rules and in particular the first wall, second wall, and two side walls having a height consistent with the vertical dimension allowed by airline carry-on luggage rules and the top wall, bottom wall, and side walls having a depth consistent with the minimum horizontal dimension allowed by airline carry-on luggage rules; a frame assembly comprising a frame sheet mounted within the internal compartment and extending along the second side, a slidably extending handle assembly attached to an upper portion of the frame sheet having a first configuration that is contracted and a second configuration extending upwardly away from the frame sheet, two wheel housings each having a wheel attached to a bottom portion of the frame sheet; a first opening defined in the receiver portion adjacent and parallel to the first wall for providing entry to the first sub-compartment from the exterior of the carrier; a zipper having complementary halves attached on either side of the first opening, the halves of the first zipper having at least one slider for reversibly separating the halves of the first zipper for permitting access to the first sub-compartment and reversibly attaching the halves of the first zipper for securing the first opening from entry from the exterior of the carrier; a second opening defined in the receiver portion adjacent to one of the second wall and the top wall providing entry to the second sub-compartment from the exterior of the receiver whereby a part of the handle assembly in the second extended configuration may extend outwardly from the second compartment through the second opening and generally vertically above the receiver; the wheels being adjacent the bottom wall and extending away from the receiver whereby the wheels can support a substantial part of the weight of the piece of luggage when the receiver is substantially above the wheels and the wheels are in contact with a surface whereby a user can grasp the handle assembly when in the second extended configuration and pull or push the receiver of the piece of luggage across the surface in an inclined position.

In yet another embodiment, the invention provides a piece of luggage comprising a receiver defining an internal compartment, a security cable made of a material that is not easily cut or broken and having a first end attached to the receiver and a free second end for attachment to an external object for preventing unauthorized removal of the piece of luggage, and a pocket defined in the receiver holding the security cable when the second end of the security cable is not attached to the external object.

OBJECTS OF THE INVENTION

It is an object and advantage of the present invention to provide a wheeled piece of luggage compact enough to meet air travel carry-on size restrictions that can accommodate bulky photographic equipment.

Another object and advantage is to provide a wheeled piece of luggage compact enough to meet air travel carry-on size restrictions that can accommodate a 400 mm 2.8 f-stop aperture telephoto lens.

Another and further object of the invention is to provide means for securing luggage that may contain valuable gear from unauthorized removal such as theft.

BRIEF DESCRIPTION OF THE DRAWINGS

Other objects, features, and advantages of the present invention will become more fully apparent from the following detailed description of a preferred embodiment, the appended claims, and the accompanying drawings in which:

REFERENCE NUMERALS IN THE DRAWINGS

Figure 1:
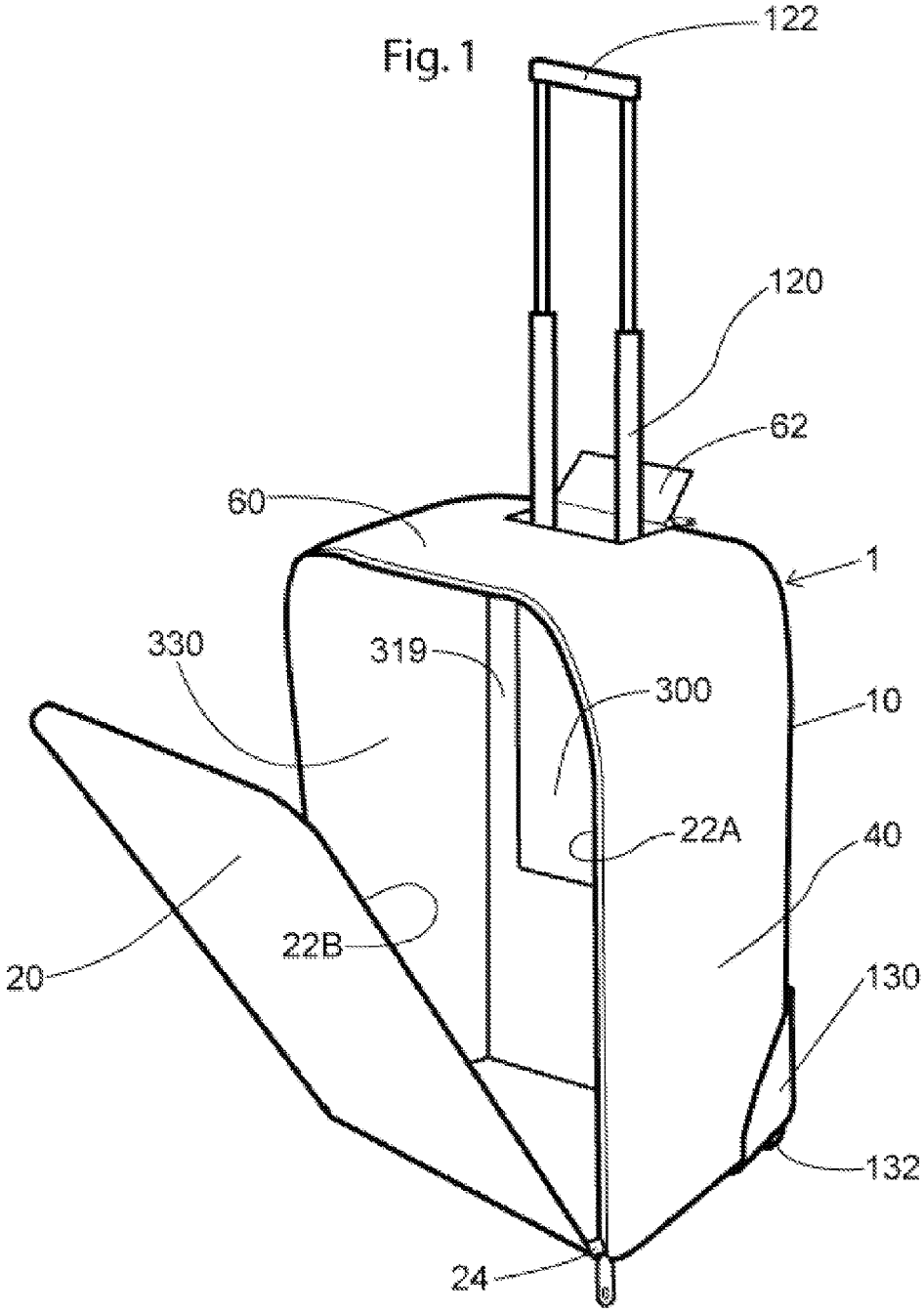
FIG. 1 is a perspective view from above of a preferred embodiment of a piece of carry-on wheeled luggage for photographic equipment according to the invention shown with its telescoping handle in an extended position.

1 preferred embodiment of piece of carry-on wheeled luggage for photographic equipment
10 receiver
20 front or first wall
22 zipper
22A zipper half
22B zipper half
24 zipper slider
26 lining
28 front foam panel
30 back or second wall
31 lining
32 seam
33 flap seam
34 flap
35 opening
37 hook strips
39 loop strips
40 right side wall
50 left side wall
60 top wall
62 zippered flap
70 bottom wall
72 bound stitched seam
80 interior compartment
82 first sub-compartment
82A bottom portion of first sub-compartment
84 second sub-compartment
100 frame assembly
102 bolt
104 nut
110 frame sheet
112 cut-out
120 telescoping handle assembly
122 handle
124 upper cross-bracket
126 lower cross bracket
130 wheel housing
132 wheel
135 screw
137 rivet
140 foot
200 400 mm 2.8 f-stop aperture telephoto zoom lens with lens hood mounted in reversed position
300 insert
310 base wall of insert
311 lining of base wall
312 lower base wall
314 upper base wall
315 foam panel
317 indented portion of upper base wall
319 unindented portion of upper base wall
320 right side wall of insert
321 seam
330 left side wall of insert
331 seam
332 foam panel
340 top wall of insert
341 bound seam
342 lining
350 bottom wall of insert
357 seam
358 seam
360 loop strip
400 security cable
410 first end of security cable
420 second end of security cable
440 pocket for security cable
450 post
460 lock

DETAILED DESCRIPTION OF THE PREFERRED EMBODIMENTS

Referring now to the drawings, a preferred embodiment of a piece of carry-on wheeled luggage for photographic equipment, indicated generally by reference numeral 1, is shown in FIGS. 1-6C. The piece of luggage 1 comprises three major components: a receiver 10, a frame assembly 100, and an insert 300, as described in more detail below.

Figures 6A, 6B:
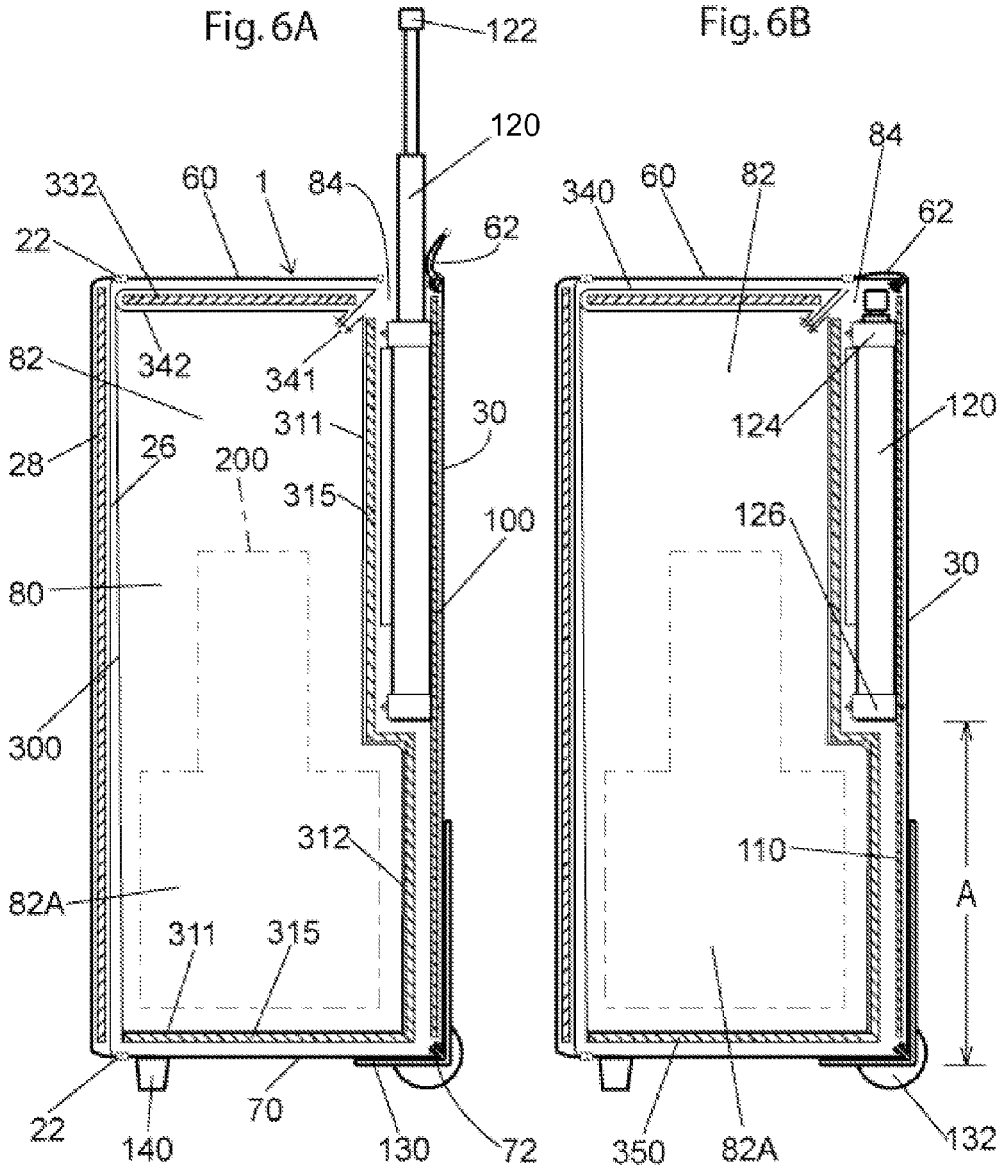
FIG. 6A is sectional view of the luggage of FIG. 1 taken along line 6A/B-6A/B of FIG. 2.
FIG. 6B is sectional view of the luggage of FIG. 1 as in FIG. 6A, but the telescoping handle is shown in the retracted position.
Figure 6C:
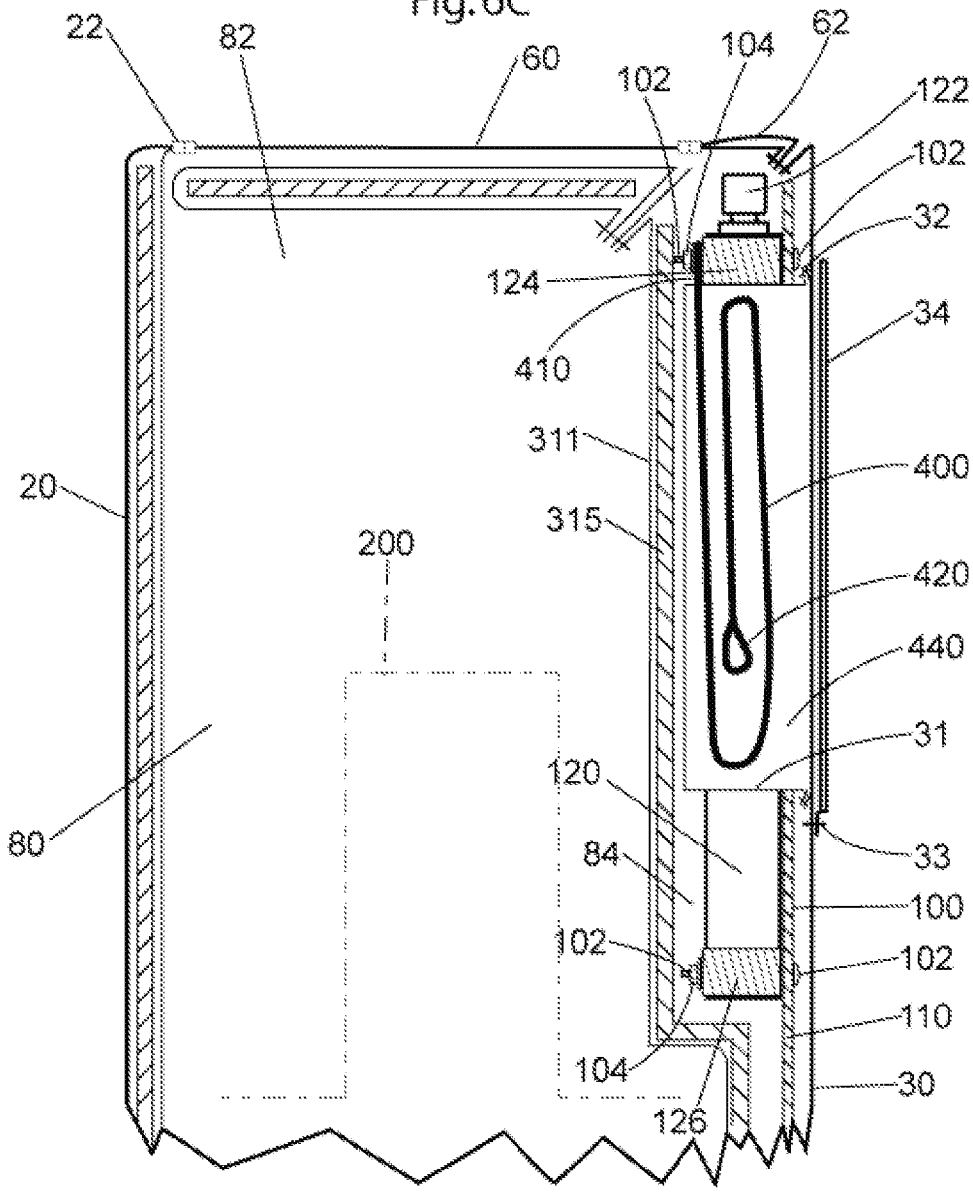
FIG. 6C is a partial perspective of the luggage of FIG. 1 taken along line 6C-6C of FIG. 2.

The receiver 10 has a front or first wall 20, a back or second wall 30, a right side wall 40, a left side wall 50, a top wall 60, and a bottom wall 70 generally joined at their edges to define a generally rectangular parallelepiped-shaped interior compartment 80 that is in turn divided into first and second sub-compartments 82 and 84 by an insert 300 contained inside the compartment 80, as may be seen in FIGS. 6A-6C. The insert 300 (shown by itself in FIGS. 8-10) serves as an internal wall dividing the first and second sub-compartments 82 and 84 as well as providing padding for the sides of the first sub-compartment 82 adjacent the two side wall 40 and 50, the top wall 60, and the bottom wall 70.

The walls 20, 30, 40, 50, 60, and 70 are preferably made of a strong and abrasion resistant fabric, such as polyester oxford cloth, coated on an interior side for water resistance.

The receiver 10 contains a frame assembly 100 sandwiched between the insert 300 and the back wall 30. The frame assembly 100 is shown in detail by itself in FIG. 7. It has an ABS frame sheet 110 which is connected by bolts 102 and nuts 104 at its upper portion to the upper cross bracket 124 and the lower cross bracket 126 of a telescoping handle assembly 120. The lower portion of the frame sheet 110 is connected by screws 135 to two wheel housings 130. Each of the wheel housings 130 contains a wheel 132 mounted on an axle.

The piece of luggage 1 therefore may be pulled along the ground in an inclined position by the handle 122 of the handle assembly 120 extending from the top wall 60 of the receiver 10 while the receiver 10 is supported by the wheels 132 mounted in the wheel housings 130.

Access to the first sub-compartment 82 is provided by a continuous opening in the top wall 60, the side walls 40 and 50, and parts of the bottom wall 70 that is closed and opened by a zipper 22 having complementary halves 22A and 22B sewn to either side of the opening. The zipper halves 22A and 22B are reversibly separated and attached by at least one zipper slider 24. Preferably two zipper sliders 24 are provided. When the zipper 22 is opened the entire front wall 20 can be rotated like a door outwards and away from the first sub-compartment 82, hinging along its connection to the bottom wall 70, as is shown in FIG. 1.

Figure 9:
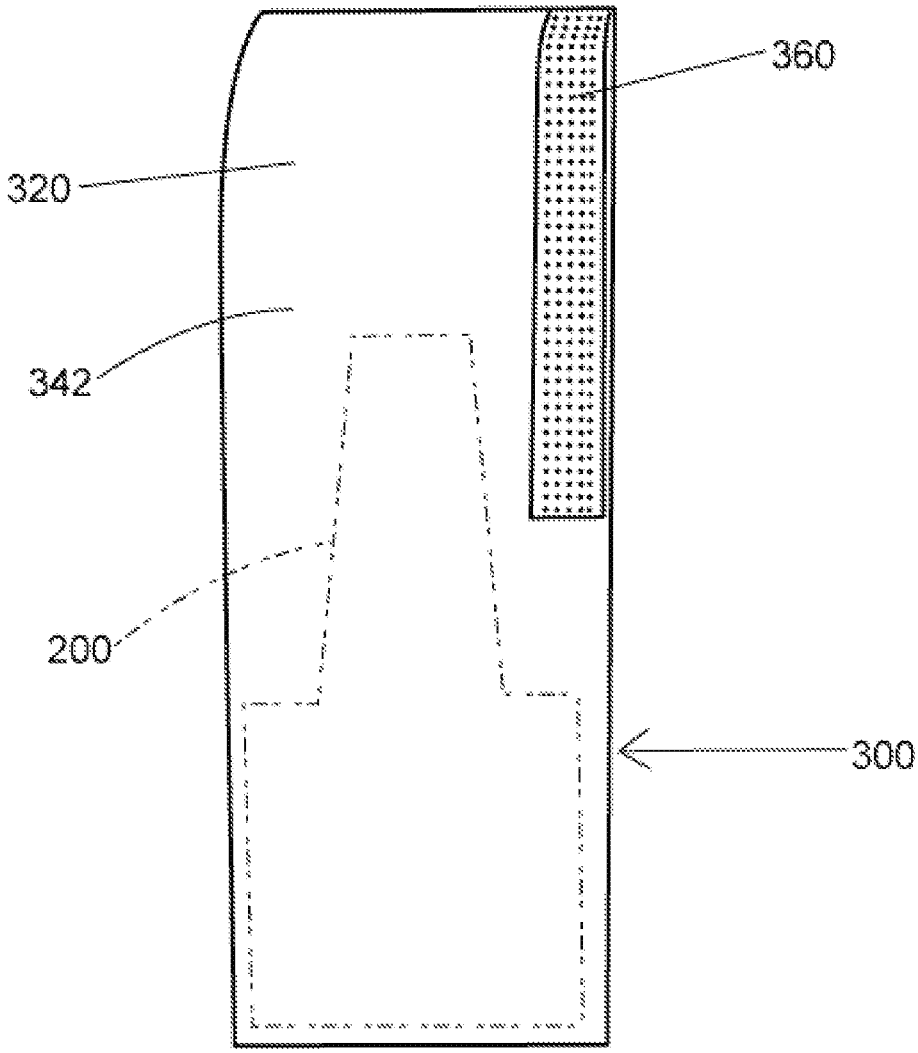
FIG. 9 is a right side view of the insert of FIG. 8.

The first sub-compartment 82 is sized and shaped to enclose photographic equipment such as camera bodies and lenses. The sectional views of FIGS. 6A and 6B, and the side view of the insert 300 in FIG. 9, show a 400 mm 2.8 f-stop aperture telephoto lens 200 (indicated in phantom because the lens 200 is not part of the luggage 10).

As is best seen in FIGS. 6A and 6B, the bottom portion 82A of the first sub-compartment 82 substantially extends across the distance ("depth") between the front wall 20 and the back wall 30. The bottom portion 82A of the first sub-compartment 82 is slightly limited in its front wall 10 to back wall 20 depth by the combined thicknesses of the lower base wall 312 of the insert 300, the frame sheet 110, and the foam sheet 28 and the liner 26 behind the front wall 20. As seen in FIGS. 6A, 6B, 6C, and 7, the frame sheet 110 is thin. The portion of the frame sheet 110 that extends between the handle assembly 120 and the wheel housings 130 therefore will not significantly reduce the depth of the bottom portion 82A of the first sub-compartment 82, so that the first sub-compartment 82 can accommodate carry very bulky or wide articles of photographic equipment such as the 400 mm 2.8 f-stop aperture telephoto lens 200 with reversed lens hood.

The vertical extent of the bottom portion 82A of the first sub-compartment 82 is indicated by the dimension "A" in FIG. 6B and extends from the bottom wall 70 vertically up to the bottom of the telescoping handle assembly 120. The vertical extent A of the bottom portion 82A is gauged to permit the receiver 10 to carry very bulky or wide articles of photographic equipment or other equipment. To be specific, the bottom portion 82A of the first sub-compartment 82 should be high enough to accommodate the length of the widest part of extra-large lenses, such as the 400 mm 2.8 f-stop aperture telephoto lens 200 with reversed hood described in the "Background" section above. As mentioned in that section, the length of the widest part of this lens, with the lens hood or sun shield attached to the lens and reversed, is 7.2 inches and its maximum width is about 8 inches. The bottom portion 82A of the first sub-compartment 82 therefore preferably should have a depth (front-to-back or between the first wall 20 and the second wall 30) of about 8 inches and a height (top-to-bottom or between the top wall 60 and the bottom wall 70) of at least 7.2 inches.

A piece of luggage 1 that was made according to the preferred embodiment and that is carry-on qualified as discussed in the "Background" section above has a bottom portion 82A of the first sub-compartment 82 that is about 8 inches deep and about 8 inches high. This luggage was an actual reduction to practice of the preferred embodiment discussed in this disclosure. It is capable of carrying the 400 mm 2.8 f-stop aperture telephoto lens with lens hood in the reversed or storage position that was described in the "Background" section above. In fact, it can even carry 500 mm and 600 mm 4 f-stop lenses, with their lens hoods attached in the reversed or storage position.

Figure 5A:
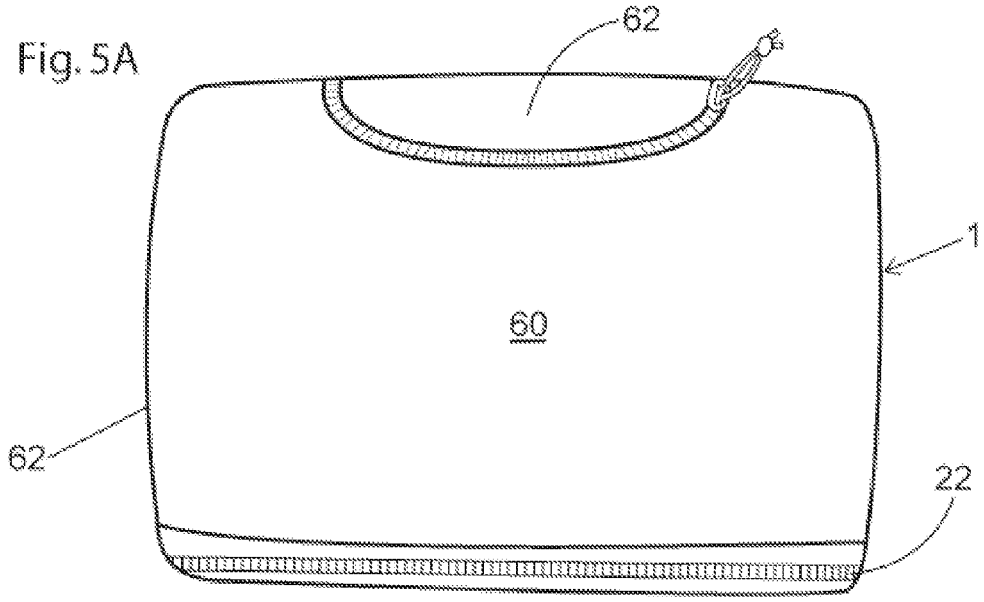
FIG. 5A is a top side view of the luggage of FIG. 1 in which its telescoping handle is retracted and covered by a zippered flap.
Figure 5B:
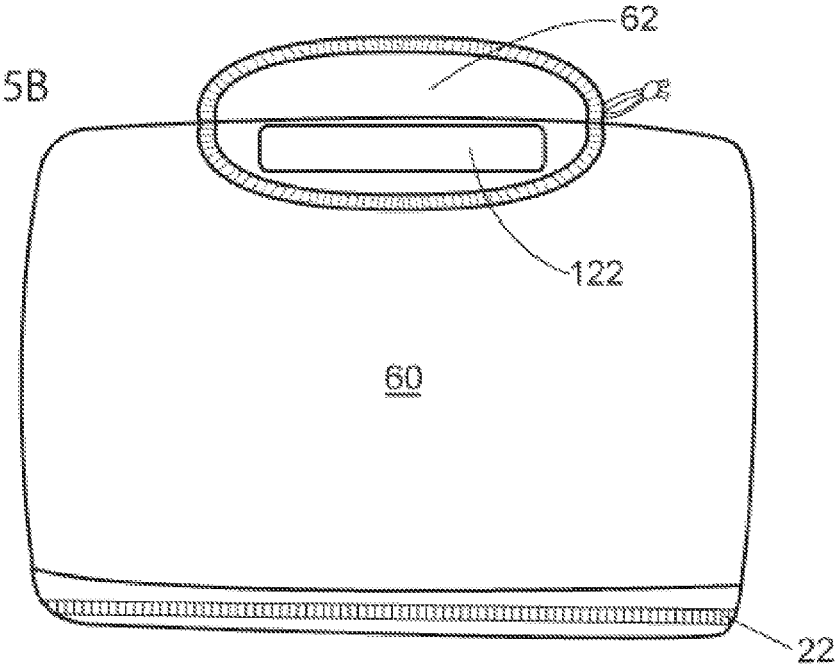
FIG. 5B is a top side view of the luggage of FIG. 1 in which its telescoping handle is not covered by the zippered flap.

The second sub-compartment 84 is sized and shaped to enclose a telescoping handle assembly 120, as shown in FIG. 6B. A zippered flap 62 covers an opening in the top wall 60 that permits access to the second sub-compartment 84 in order to withdraw and thus extend the telescoping handle assembly 120 into an operative position for use in pulling the piece of luggage 1 by hand. The flap 62 can be zippered into place over the fully contracted telescoping handle assembly 120, thus closing the sub-compartment 84, as shown in FIGS. 5A and 6B. The zippered flap 62 may be omitted if the handle 122 of the handle assembly 120 is intended to be exposed when the telescoping handle assembly 120 is fully retracted, as in many known pieces of wheeled luggage.

The telescoping handle assembly 120 may have a construction of a sort known to the rolling luggage art. The telescoping handle assembly 120 selected for use in the piece of luggage 1 has a vertical dimension when in its fully retracted configuration that is only sub-part of the vertical dimension of the back wall 30, unlike known wheeled luggage, so as to increase the height (the dimension indicated by "A") of the bottom portion 82A of the first sub-compartment 82, the portion that has a region of maximum depth at the bottom of the first sub-compartment 82.

The telescoping handle assembly 120 preferably should be no longer than about 13 inches in the vertical dimension when contracted as shown in FIG. 6B. This restriction permits the first sub-compartment 82 to accommodate the widest part of extra-large lenses, such as the 400 mm 2.8 f-stop aperture telephoto zoom lens, while allowing the piece of luggage 1 to just meet the carry-on luggage height restriction (22 inches high) that will satisfy most airlines. In such a case, the ratio of the length in the vertical dimension of the second sub-compartment 84 to the overall vertical or height dimension of the piece of luggage 1 (the separation of the top wall 60 from the bottom wall 70) will be approximately 0.59 and the ratio of the length in the vertical dimension of the bottom portion 82A of the first sub-compartment 82 to the overall vertical or height dimension of the piece of luggage 1 will be approximately 0.41.

The maximum length in the vertical dimension of the second sub-compartment 84 will have to be shorter than about 13 inches if the piece of luggage 1 is to have a shorter height but still accommodate the extra-large telephoto lens. This is because the height of the bottom portion 82A of the first sub-compartment 82 (dimension "A") must remain substantially unchanged in order to accommodate the widest part of an extra-large lens, such as the 400 mm 2.8 f-stop aperture telephoto zoom lens 200. The ratio of the length in the vertical dimension of the second sub-compartment 84 to the overall vertical or height dimension of the piece of luggage 1 therefore generally will be less than or equal to approximately 0.59 and the ratio of the length in the vertical dimension of the bottom portion 82A of the first sub-compartment 82 to the overall vertical or height dimension of the piece of luggage 1 therefore generally will be greater than or equal to approximately 0.41.

Figure 7:
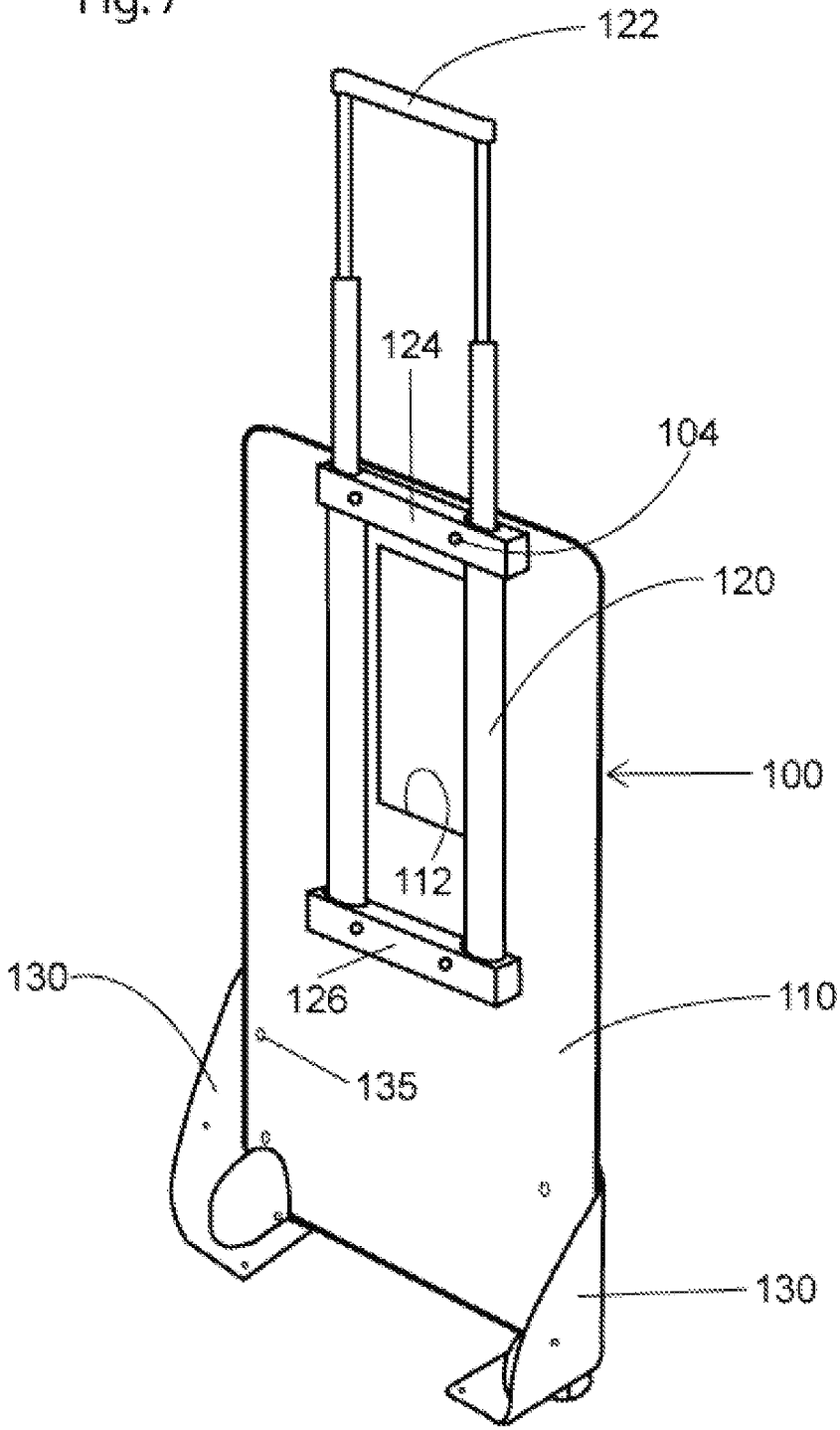
FIG. 7 is a perspective view from above of the frame assembly system for the luggage of FIG. 1.

The manner of construction of the carrier 1 may be observed by referring to the sectional views of FIGS. 6A and 6B and the perspective view of the frame assembly 100 shown in FIG. 7. FIGS. 6A and 6B are somewhat simplified for clarity. Front wall 20 is lined with a lining 26, preferably a nylon fabric, on the interior of the wall 20 facing compartment 80. The lining 26 and the front wall 20 sandwich a front foam panel 28 preferably made of cross-linked polyethylene foam. The front foam panel 28 is enclosed by stitched seams where the front wall 20 and the lining 26 are stitched to the zipper half 22B and by a stitched seam (not shown in FIGS. 6A and 6B) where the front wall 20 is stitched to the bottom wall 70 between the ends of the zipper 22.

The back wall 30 is joined to the bottom wall 70 by a bound stitched seam 72. Although not shown in FIGS. 6A and 6B, similar stitched seams join the back wall 30 to the right side wall 40 and the left side wall 50.

Figure 8:
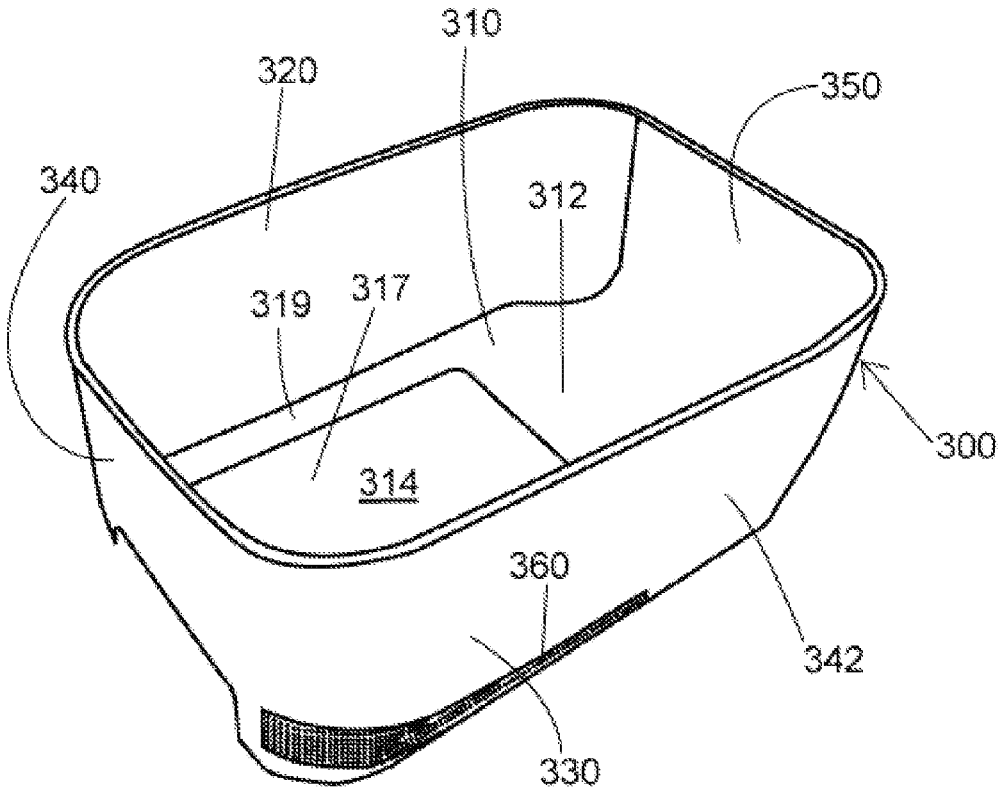
FIG. 8 is a perspective view from above of an insert for the luggage of FIG. 1.
Figure 10:
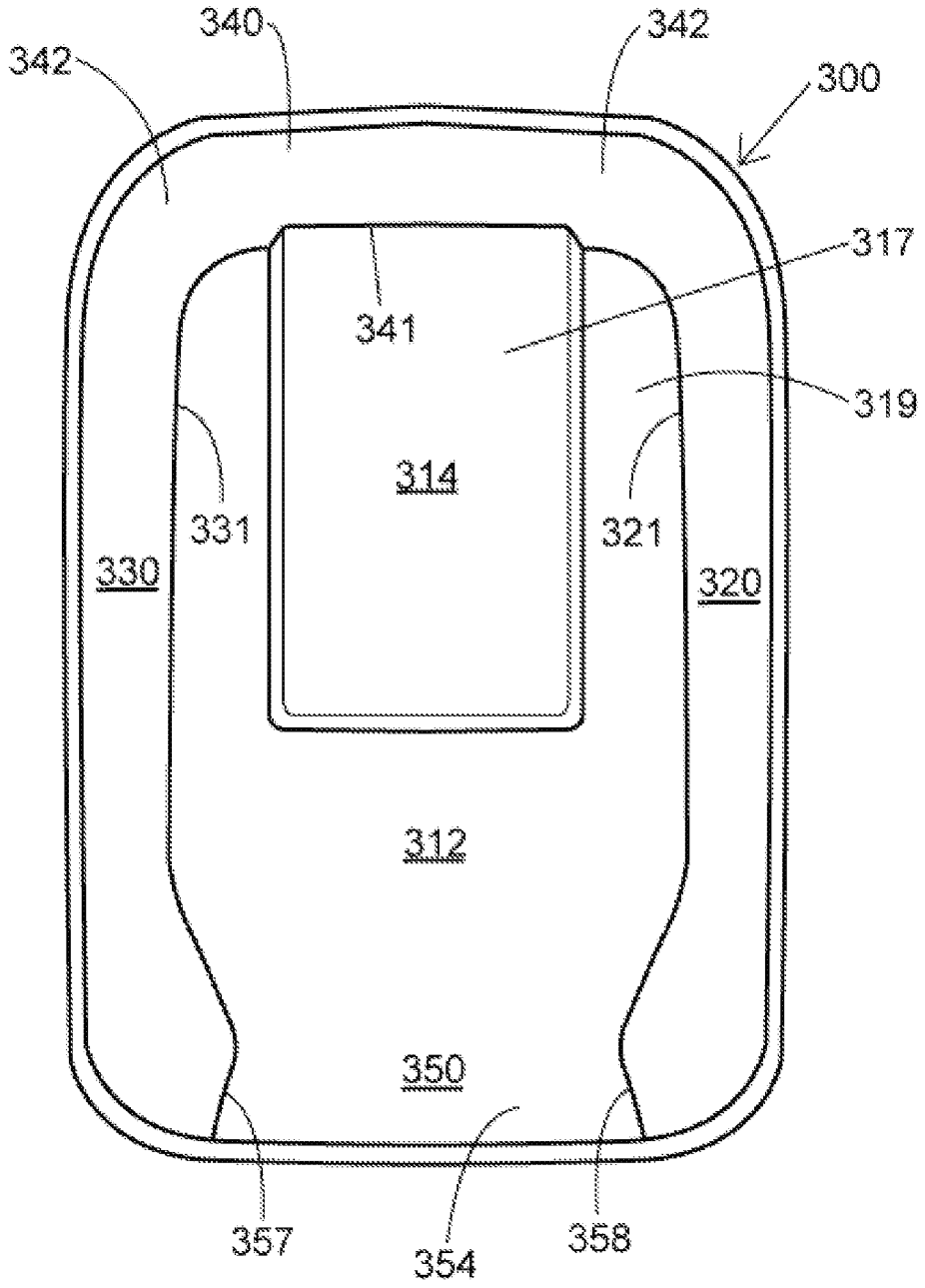
FIG. 10 is a front side view of the insert of FIG. 8.

The insert 300 is shown by itself in FIGS. 8-10. The insert 300 resembles a padded tub that is sized and shaped to fit inside the compartment 80 of the receiver 10. It has a base wall 310 formed as one unit with the bottom wall 350 and joined to a right side wall 320, a left side wall 330, and a top wall 340. The right side wall 320, the left side wall 330, and the top wall 340 are also formed as a single unit.

The insert 300 has loop strips or bands 360 sewn to the right side wall 320, left side wall 330, top wall 340, and bottom wall 350 that detachingly engage hook strips or bands sewn to the inside surfaces (the surfaces facing or adjacent compartment 80) of the right side wall 40, the left side wall 50, the top wall 60, and the bottom wall 70 and thereby secure the insert 300 in the compartment 80 of the receiver 10. The loop strips 360 and the corresponding hook strips are not shown in FIGS. 6A and 6B.

The base wall 310 and the bottom wall 350 are made of a molded foam panel 315 adhered to a lining 311. The foam panel 315 is preferably made of closed-cell cross-linked polyethylene foam. The foam panel is molded over a form by heat and pressure in the region of the upper base wall 314 to provide an indented portion 317 that will accommodate the handle assembly 120, as shown in FIGS. 6A, 6$B_1$ and 6C.

The indented portion 317 in this preferred embodiment is not as wide as the insert 300 because the handle assembly 120 has a width, when installed, which is only a fraction of the width of the insert 300. In this configuration the upper base wall 314 is continuous with the lower base wall 312 on either side of the indented portion 317 so that the base wall 310 continues uninterrupted from bottom to top on either side of the indented portion 317. As a result, the upper base wall 314 will appear to have depressions or unindented portions 319 on either side of the indented portion 317. The unindented portions 319 will provide more room in the first sub-compartment 82 for accommodating equipment.

The top wall 340 and the right and left side walls 320 and 330 of the insert are comprised of the lining 342 enclosing a continuous foam panel 332. The lining 342 is sewn to the lining 311 in the base wall 310 at the seams 321, 331, 341, 357, and 358 (see FIG. 10).

Figure 2A:
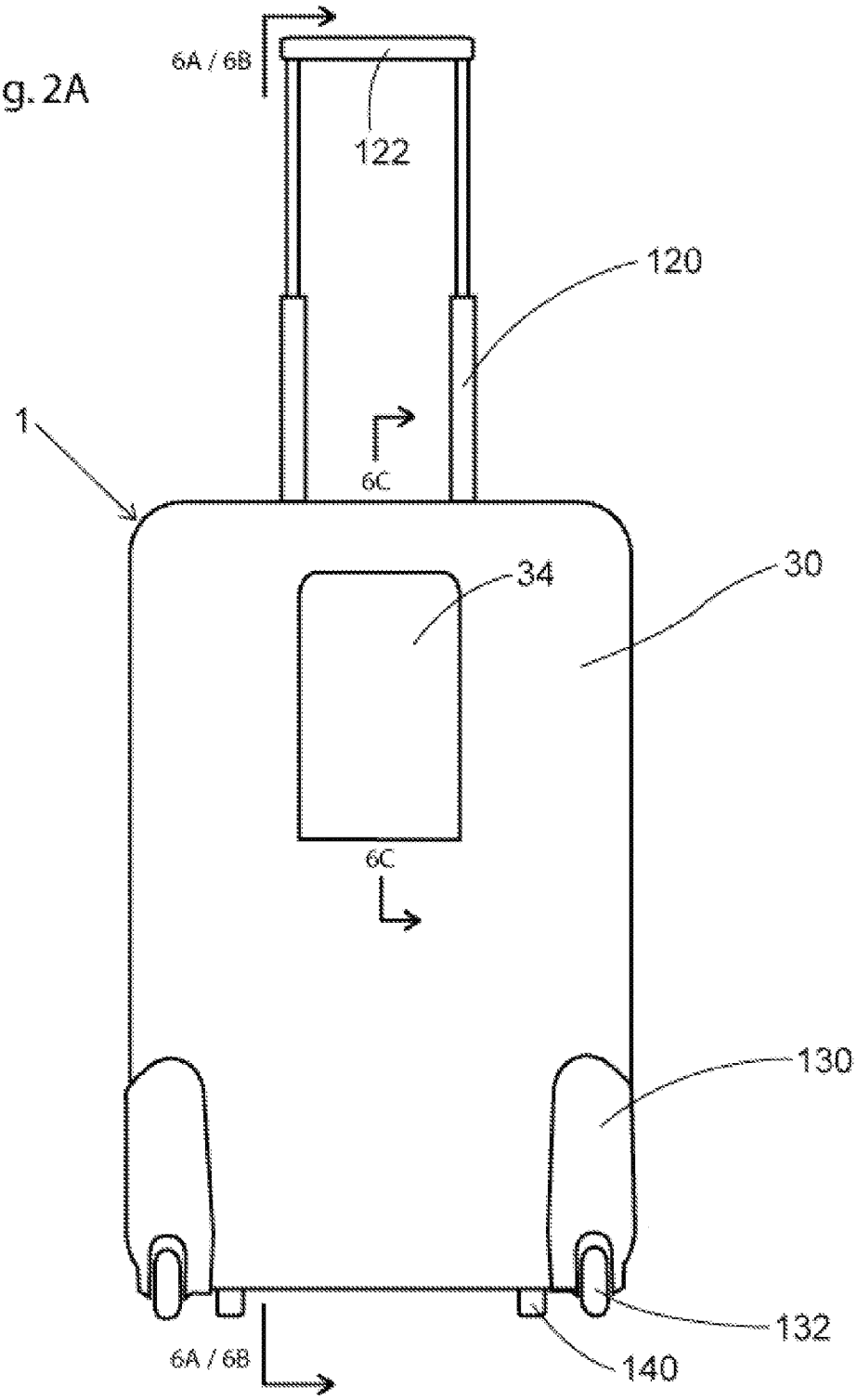
FIG. 2A is a back side view of the luggage of FIG. 1.

The luggage 1 also contains means for securing the luggage 1 to an external object such as a post, fence, vehicle or tree in order to prevent unauthorized removal of the luggage 1, such as by theft, accident or inadvertent confusion on the part of the owner of a luggage of similar appearance. The securing means preferably comprises a security cable 400. FIG. 2A shows the security cable 400 deployed from the receiver 10 and looped around a post 450 and fastened to itself by a padlock 460.

When not in use, the security cable 400 is curled up or tucked into a pocket 440 formed in the receiver 10 and the frame assembly 100, as may be best seen in FIG. 6C. The frame sheet 110 has a cut-out 112 formed therein in the vicinity of the handle assembly 120 and preferably between the telescoping rods of the handle assembly 120. The cut-out 112 in the frame sheet 110 allows the formation of the pocket 440 between the back wall 20 of the receiver 10 and the indented portion 117 of the upper base wall 314 of the insert 300.

The back wall 30 of the receiver 10 contains an opening 35 adjacent to the cut-out 112 of the frame sheet 110. The opening 35 provides access from the exterior of the receiver 10 to the pocket 440. A lining 31 is sewn at seams 32 to the back wall 30 of the receiver 10 for lining the pocket 440.

Figure 2B:
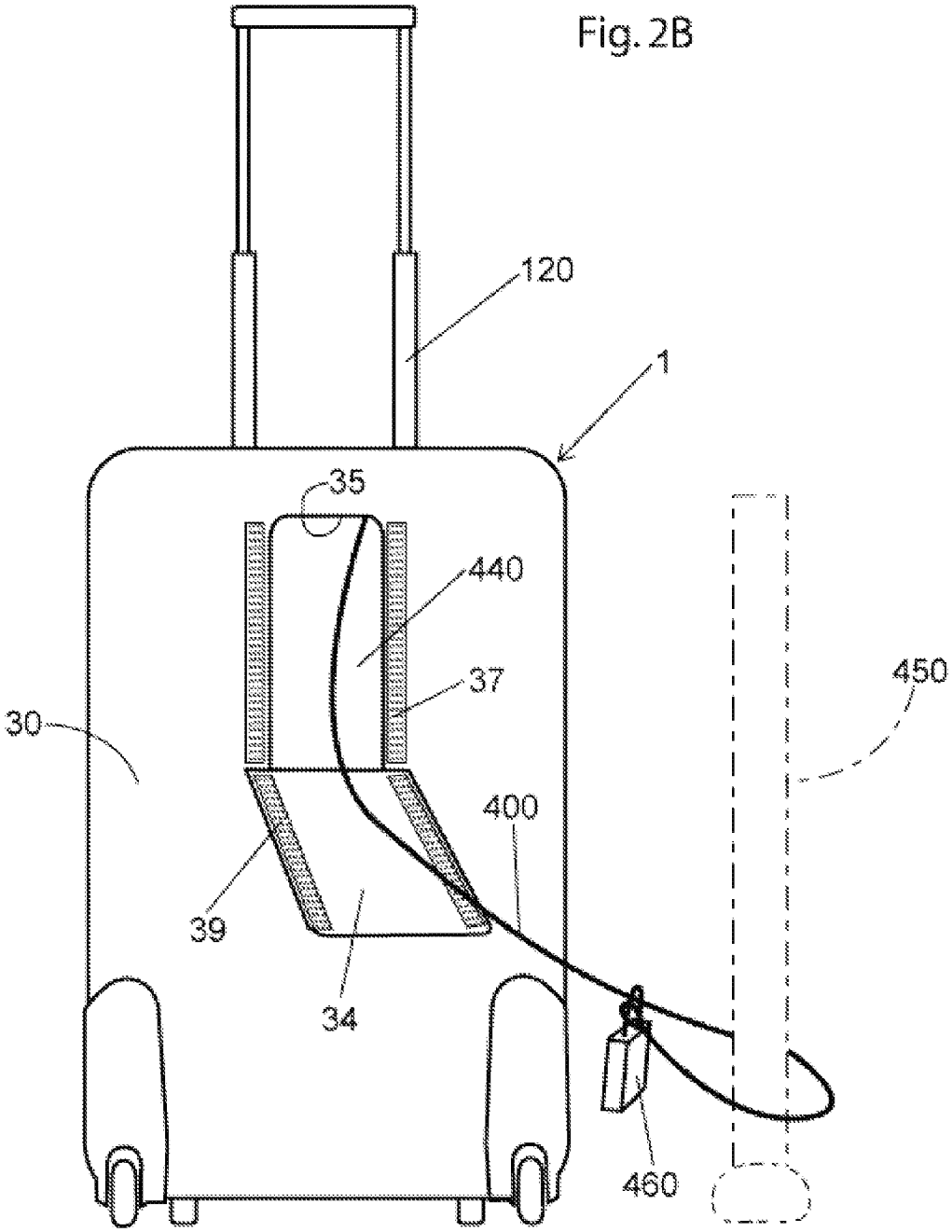
FIG. 2B is a perspective of the back side of the luggage of FIG. 1, showing the security cable deployed and secured to a post.
Figure 3:
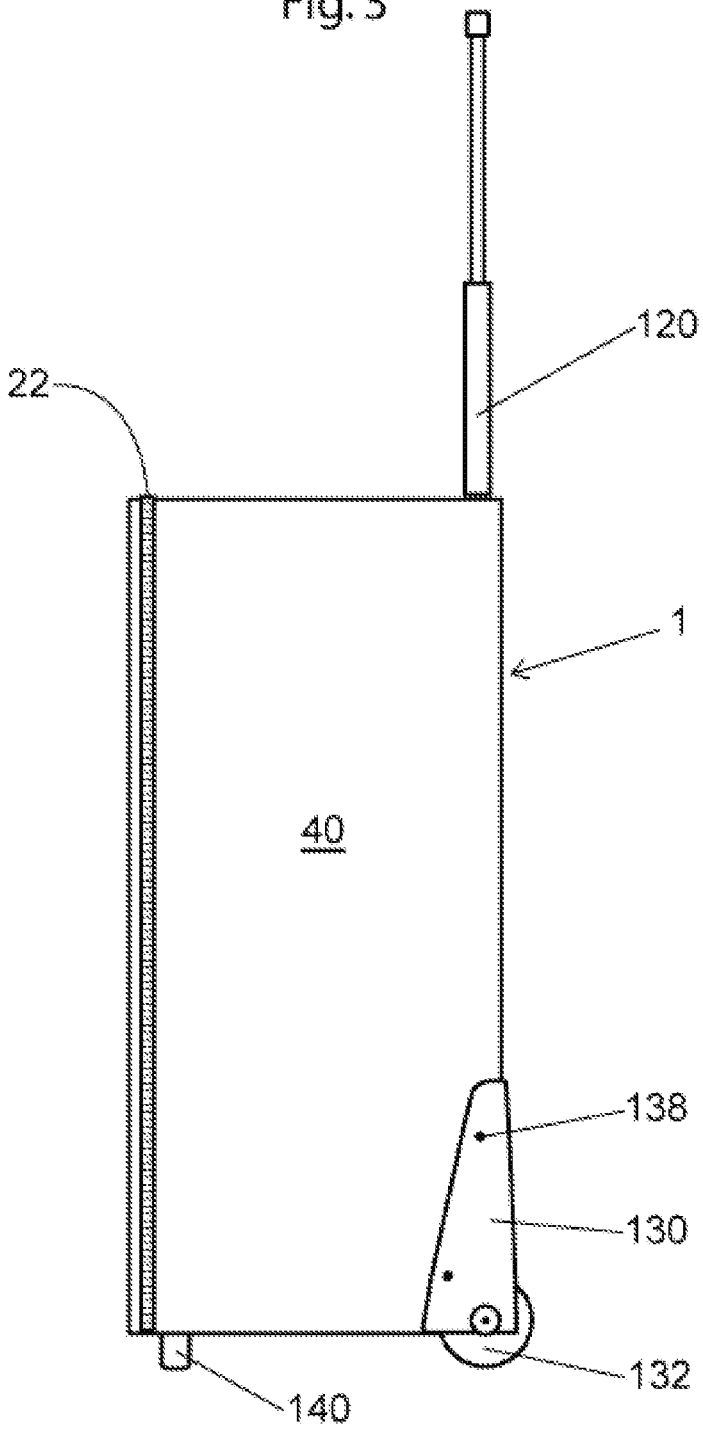
FIG. 3 is a right side view of the luggage of FIG. 1.
Figure 4:
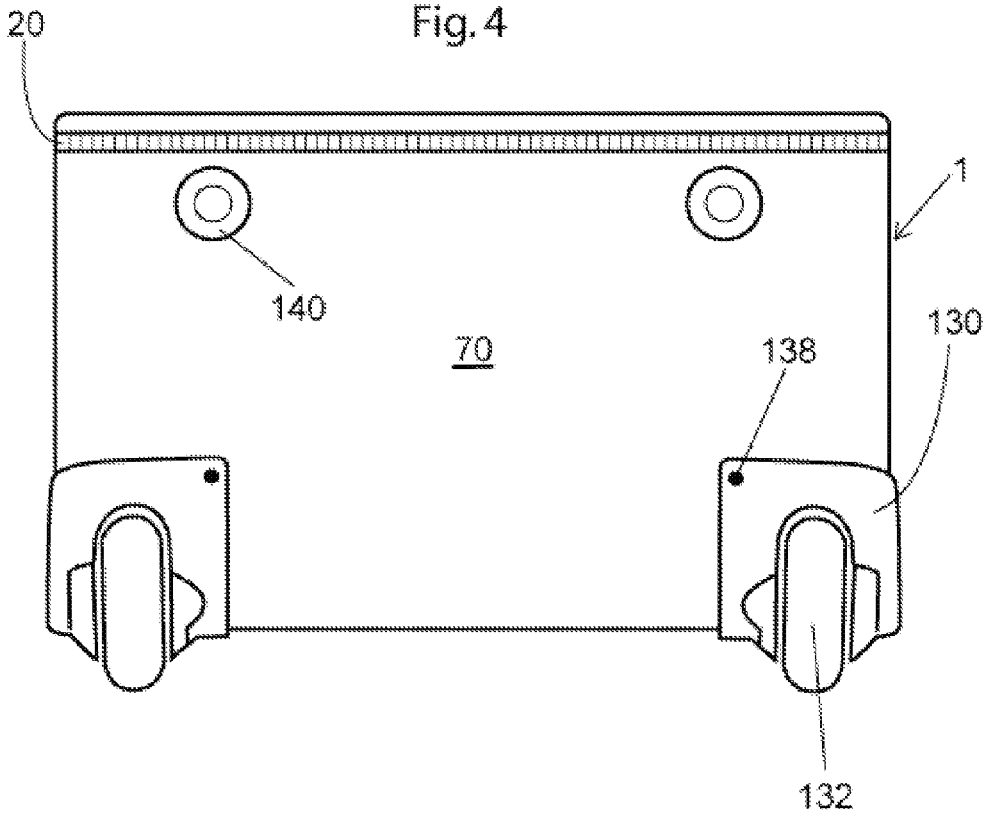
FIG. 4 is a bottom side view of the luggage of FIG. 1.

The opening 35 is covered by a folding flap 34 sewn at the seam 33 to the back wall 30. The flap 34 may be folded down in a first position to permit access to the security cable in the pocket 440 when it is needed, as shown in FIG. 2B. In a second position, the flap 34 may be placed over the opening 35 to cover the pocket 440 and to prevent access into the interior of the receiver 10 when the security cable is to be secured inside the pocket 420, as shown in FIGS. 2A and 6C. Hook strips 37 are sewn to the back wall 30 on either side of the opening 35 for engagement with loop strips 39 sewn to the flap 34 in order to detachably secure the flap 34 to the back wall 30 and thereby cover the opening 35. The respective positioning of the hook strips 37 and the loop strips 39 may be alternated, of course, and other means may be provided for securing the flap 34 to the back wall 30, such as a zipper, buckle, and the like. It will also be appreciated that the flap 34 may be secured to the back wall when the security cable 400 is deployed, in which case the flap 34 will be secured over the security cable 400.

The security cable 400 preferably has a first end 410 and a second end 420. Each end 410 and 420 comprises a loop formed in the security cable 400 by use of a swage or the like. The first end 410 is secured to the frame assembly 100 by a bolt 102 and nut 104 combination in which the bolt 102 is placed through the loop at the first end 410 and inserted through a hole in the upper cross bracket 124. The loop in the second end 420 of the security cable 400 is used to secure the cable 400 to itself with a lock 460 as shown in FIG. 2A.

The security cable 400 is preferably made of steel cable but may be made of other materials such as steel chain, Kevlar webbing and the like as long as the material chosen is tough and not easily broken or cut. The second end 420 may be equipped with a built-in lock rather than a padlock. Many variations of the security cable and its locking means will occur to the person of skill in the art once it is apparent that the purpose of the security cable 400 is to prevent unauthorized movement or removal of the luggage 1.

Many variations of attaching the security cable 400 to the luggage 1 are possible. For example, the loop in the first end 410 might be placed around a component of the handle assembly 120 rather than being fastened to it by means of a bolt. Alternatively, the first end 410 could be attached to some other part of the frame assembly 100 or sewn to a point on the inside of the receiver 10 such as the interior of the back wall 30. Attachment to the frame of the luggage, if a frame is present, is currently preferred because the security cable will be more difficult to remove from the receiver 10 if it is attached at one end to the frame assembly 100.

As the reader will have seen, the piece of luggage according to the preferred embodiment 1 has three major components: the receiver 10, the frame assembly 100, and the insert 300. After construction of the receiver 10, the frame sheet 110, having been riveted to the telescoping handle assembly 120, is inserted into the compartment 80 through the opening made by unzipping the zipper 22 and rotating the front wall 20 away from the top wall 60 and the side walls 40 and 50.

The frame sheet 110 is placed against the back wall 30 with the telescoping handle assembly 120 positioned on the side of the frame sheet 110 not contacting the back wall 30. The telescoping handle assembly will be located under the opening covered by the flap 62. Next, the wheel housings 130 are placed against the outsides of the back wall 30 and the bottom wall 70 at the two lower corners of the piece of luggage 1 on the back side 30. Two spaced openings (not shown) are formed or cut in the back wall 30 and the bottom wall 70 at these locations at the juncture of the back wall 30 and the bottom wall 70. These openings each receive the wheel-containing portion of one of the wheel housings 130. The screws 135 are then applied to join the wheel housings 130 to the frame sheet 110 (see FIGS. 2 and 7). The rivets 137 are applied so that they penetrate the bottom wall 70, the right side wall 40, and the left side wall 50 join the wheel housings 130 to these walls (see FIGS. 2-4). These means of attachment will firmly secure the now-assembled frame assembly 100 to the receiver 10.

Preferably, the wheels 132 are arranged to protrude outside the plane of the back wall 30 (see FIGS. 3 and 4) so that the piece of luggage may be more easily drawn over a curb.

Also, the wheels 132 preferably are large, set as far apart as possible for stability, and are replaceable.

The feet 140 are joined by bolts, nuts, and washers to the bottom wall 70 adjacent and behind the zipper 20 in order to raise the surface of the bottom wall 70 above the ground when the piece of luggage 1 is resting in an upright position. The feet 140 are preferably molded or milled of a firm and durable material such as a thermoplastic or metal alloy.

The last step of assembly of the piece of luggage 1 is to place the insert 300 into the compartment 80 of the receiver 10, attaching the mating hook and loop strips on the insert 300 and the interior of the receiver 10 as discussed earlier.

While the invention has been described in conjunction with the preferred embodiment, it will be understood that it is not intended to limit the invention to that embodiment. On the contrary, the invention is intended to cover alternatives, modifications and equivalents that may be included within the spirit and scope of the invention as defined by the appended claims.

The invention claimed is:

1. A piece of carry-on luggage for articles such as photographic equipment and the like, comprising:

a receiver having a first wall, a second wall, two side walls, a top wall, and a bottom wall, the first wall and the second wall facing each other and being joined to the bottom wall, the side walls, and the top wall so as to define an internal compartment, the receiver having dimensions consistent with airline carry-on luggage rules and in particular the first wall, second wall, and two side walls having a height consistent with the vertical dimension allowed by airline carry-on luggage rules and the top wall, bottom wall, and side walls having a depth consistent with the minimum horizontal dimension allowed by airline carry-on luggage rules;

an internal wall located in the internal compartment and attached to one or more of the side walls, a top wall, and a bottom wall so as to separate the internal compartment into first and second sub-compartments, the first sub-compartment being adjacent to both substantially most of the first wall and substantially a bottom portion of the second wall, the second sub-compartment being adjacent substantially to an upper portion of the second wall, the first sub-compartment being sized to be capable of accommodating at least a 400 mm 2.8 f-stop aperture telephoto lens, a first opening defined in the receiver portion adjacent and parallel to the first wall for providing entry to the first sub-compartment from the exterior of the carrier, a zipper having complementary halves attached on either side of the first opening, the halves of the zipper having at least one slider for reversibly separating the halves of the zipper for permitting access to the first sub-compartment and reversibly attaching the halves of the zipper for securing the first opening from entry from the exterior of the carrier, a second opening defined in the receiver portion adjacent to one of the second wall and the top wall providing entry to the second sub-compartment from the exterior of the receiver, two wheel housings having wheels mounted therein attached to the receiver adjacent the bottom wall and extending away from the receiver whereby the wheels can support a substantial part of the weight of the piece of luggage when the receiver is substantially above the wheels and the wheels are in contact with a surface; and an extendable handle assembly attached to the receiver and containable within the second sub-compartment when in a first contracted configuration and having a second extended configuration whereby a part of the handle assembly extends outwardly from the second sub-compartment through the second opening and generally vertically above the receiver whereby a user can grasp the handle assembly and pull or push the receiver of the piece of luggage across the surface in an inclined position.

2. The piece of carry-on luggage according to claim 1 further comprising a frame sheet located in the internal compartment to which the extendable handle assembly is attached at an upper end thereof and the wheel housings are attached to a lower end of the frame sheet, the combination of the frame sheet and the extendable handle assembly comprising a frame assembly.

3. The piece of carry-on luggage according to claim 2 further comprising:

a security cable made of a material that is not easily cut or broken and having a first end attached to the receiver and a free second end for attachment to an external object for preventing unauthorized removal of the piece of carry-on luggage, a pocket defined in the receiver for holding the security cable when the second end of the security cable is not attached to the external object, and wherein the first end of the security cable is attached to the frame assembly.

4. The piece of carry-on luggage according to claim 3 in which at least a part of the frame assembly is contained at least in the internal compartment of the receiver and the first end of the security cable is attached to the part of the frame assembly contained inside the internal compartment.

5. The piece of carry-on luggage according to claim 1 further comprising:

a security cable made of a material that is not easily cut or broken and having a first end attached to the receiver and a free second end for attachment to an external object for preventing unauthorized removal of the piece of carry-on luggage, and a pocket defined in the receiver for holding the security cable when the second end of the security cable is not attached to the external object.

6. The piece of carry-on luggage according to claim 5 further comprising means for locking the second end of the security cable to the security cable so that the security cable can be detachably secured around the external object.

7. The piece of carry-on luggage according to claim 5 in which the pocket is covered by a flap that can move from a first position that permits access to the security cable for removing the second end of the security cable from the pocket to a second position for covering the pocket.

8. The piece of carry-on luggage according to claim 5 wherein the pocket is defined in the side wall of the receiver that is adjacent the frame assembly.

9. The piece of carry-on luggage according to claim 1 wherein the ratio of the vertical length of the handle assembly when in the first contracted configuration thereof to the height of the receiver is equal to or less than about 0.59.

10. The piece of carry-on luggage according to claim 1 wherein the first sub-compartment is capable of accommodating at least a 500 mm telephoto lens.

11. The piece of carry-on luggage according to claim 1 wherein the first sub-compartment is capable of accommodating at least a 600 mm telephoto lens.

12. The piece of carry-on luggage according to claim 1 wherein the internal wall and the first wall comprise padding and the padding of the internal wall and the first wall protect contents of the first sub-compartment.

* * * * *